US005439017A

United States Patent [19]

Brown

[11] Patent Number: 5,439,017

[45] Date of Patent: Aug. 8, 1995

[54] COLLAPSIBLE FRAME

[75] Inventor: Douglas M. Brown, Monterey, Calif.

[73] Assignee: Blue Leaf Design, Inc., Monterey, Calif.

[21] Appl. No.: 254,985

[22] Filed: Jun. 7, 1994

[51] Int. Cl.[6] ..... E04H 15/40

[52] U.S. Cl. ..... 135/126; 135/128; 135/138; 135/132; 135/121

[58] Field of Search ..... 135/126 OR, 128, 130, 135/132, 136, 138, 121, 124

[56] References Cited

U.S. PATENT DOCUMENTS

| | | | |
|---|---|---|---|
| 3,863,659 | 2/1975 | Gillis . | |
| 3,960,161 | 6/1976 | Norman | 135/126 |
| 3,986,519 | 10/1976 | Gillis . | |
| 3,990,463 | 11/1976 | Norman | 135/126 |
| 4,099,533 | 7/1978 | Gillis . | |
| 4,175,305 | 11/1979 | Gillis . | |
| 4,825,892 | 5/1989 | Norman | 135/126 |
| 4,858,634 | 8/1989 | McLeese | 135/126 |
| 5,038,812 | 8/1991 | Norman | 135/126 |
| 5,080,119 | 1/1992 | Scherer . | |
| 5,117,852 | 6/1992 | Bryant . | |
| 5,137,044 | 8/1992 | Brady | 135/126 |
| 5,213,147 | 5/1993 | Zheng . | |
| 5,249,592 | 10/1993 | Springer et al. | 135/126 |
| 5,301,705 | 4/1994 | Zheng . | |
| 5,385,165 | 1/1995 | Hazinski et al. | 135/126 |
| 5,396,917 | 3/1995 | Hazinski et al. | 135/128 X |

FOREIGN PATENT DOCUMENTS

| | | | |
|---|---|---|---|
| 2635136 | 2/1990 | France | 135/126 |
| 3021779 | 1/1991 | Japan | 135/126 |
| 943744 | 12/1963 | United Kingdom | 135/138 |

*Primary Examiner*—Carl D. Friedman
*Assistant Examiner*—Wynn E. Wood

[57] ABSTRACT

A frame of flexible hoops sets up automatically through spring tension. The frame has a first hoop and a second hoop attached to the first hoop at equally spaced apart quadrant points. The hoops can flex and twist relative to each other at the quadrant points, but cannot translate away from each other. Tension members hold the erected frame into an oblong shape. Fabric or elastic panels can form the floor, roof and sides, of a tent. The frame may be collapsed to a compact size by folding it into a series of spiralling hoops, against the spring force of the frame.

13 Claims, 6 Drawing Sheets

COLLAPSIBLE FRAME

BACKGROUND OF THE INVENTION

The field of the invention is wire frame structures. More particularly, the field of the invention is self-erecting wire frame structures for use in tents, canopies, or other designs using a wire frame for support.

Various wire frame structures have been known and used in, for example, camping tents, and other products. A wire frame structure advantageously has spring characteristics designed to allow it to automatically set up without using poles, wires, stakes, etc. In addition, the wire frame structure is preferably folded or compacted into a small size for storage or transport, yet when released from its compact position, expands and erects, without substantial effort by the user. While various such frames, including tent frames, have been known and used in the past, they can be bulky, difficult to erect, difficult to fold or compact, etc. Accordingly, there remains a need for a self-erecting frame which can be folded to a compact size, and yet easily and automatically set up into a frame for a tent, or the like.

SUMMARY OF THE INVENTION

To these ends, a self-assembled, or self-erecting frame includes a first hoop and a second hoop attached to the first hoop at generally equally spaced apart first, second, third and fourth quadrant points. The first hoop advantageously crosses the second hoop at approximately right angles at the first and third quadrant points. Spaced apart tension members join the first and second hoops. Preferably, one or more fabric sheets or panels are attached to the frame, to form a tent used for camping or as a children's toy.

Accordingly, it is an object of the invention to provide an improved frame for a tent, or other similar structure, such as, a canopy, kite, sculpture, furniture, lamp shade, reflector or other products having a frame, optionally including one or more sheets, panels, skins, or shells.

BRIEF DESCRIPTION OF THE DRAWINGS

In the drawings, wherein similar reference characters denote similar elements through the several view.

DETAILED DESCRIPTION OF THE DRAWINGS

Figure 1:
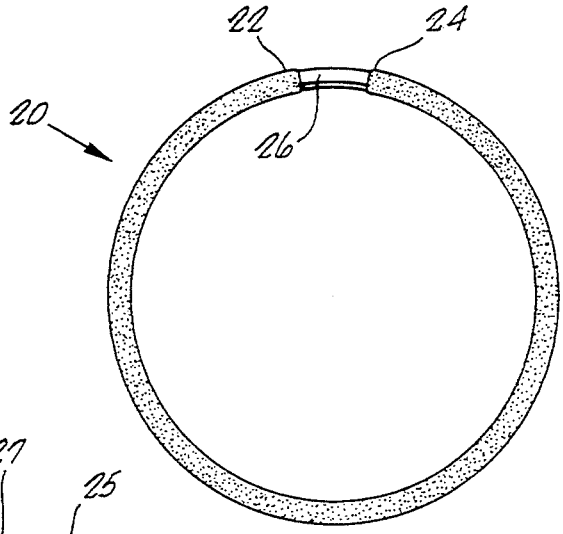
FIG. 1 is a plan view of a first hoop of the present frame.
Figure 2:
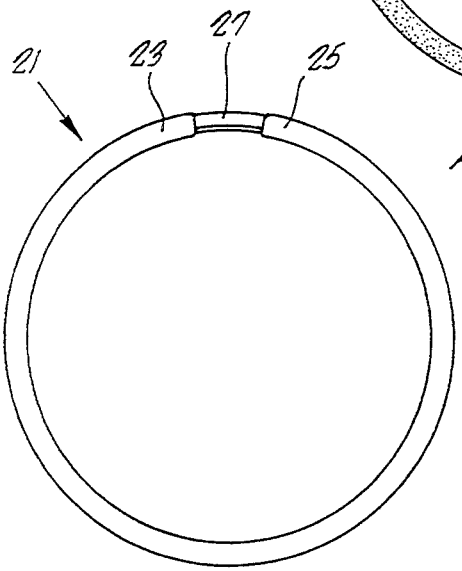
FIG. 2 is a plan view of a second hoop of the present frame.

Turning now in detail to the drawings, FIGS. 1–7 illustrate the assembly and construction of the present frame. As shown in FIG. 1, a first hoop 20 has a first end 22 and second end 24 joined at pivot joint 26. As shown in FIG. 2, a second hoop 21 similarly has a first end 23 and a second end 25 joined at a pivot joint 27. The first hoop 20 and the second hoop 21 may be identical to each other, but are shown in the figures in contrasting form, for clarity of illustration and description.

The first hoop 20 and second hoop 21 are each advantageously made by bringing a length of straight spring steel wire into a circle and joining the ends at the pivot joints 26 and 27. The pivot joints axially align the ends of each hoop, and fix the ends so they cannot translate relative to each other, while allowing the ends of each hoop to freely rotate axially relative to each other.

Figure 3:
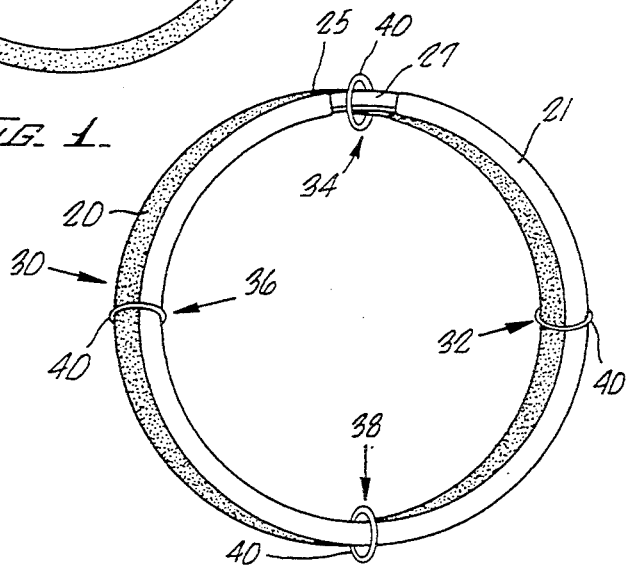
FIG. 3 is a plan view of the first hoop of FIG. 1, overlying and attached to the second hoop of FIG. 2, to form a hoop assembly.

Referring to FIG. 3, to continue with construction of the present frame, the second hoop 21 is placed over and attached to the first hoop 20 at first, second, third and fourth quadrant points 32, 34, 36, and 38, by fasteners 40. The quadrant points are generally equally spaced apart. In a preferred embodiment, the fasteners 40 are elastic bands which advantageously have sufficient tightness and friction on the hoops to prevent the hoops 40 from shifting away from the quadrant points, yet are flexible to permit the hoop wire ends to twist or rotate relative to each other at the quadrant points.

Figure 4:
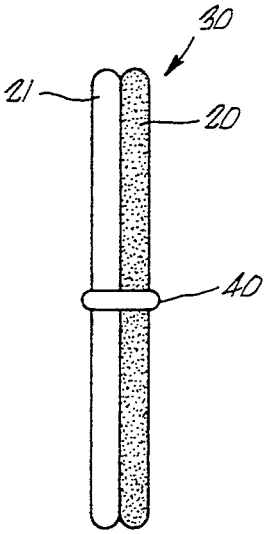
FIG. 4 is a side elevation view of the hoop assembly of FIG.
Figure 5:
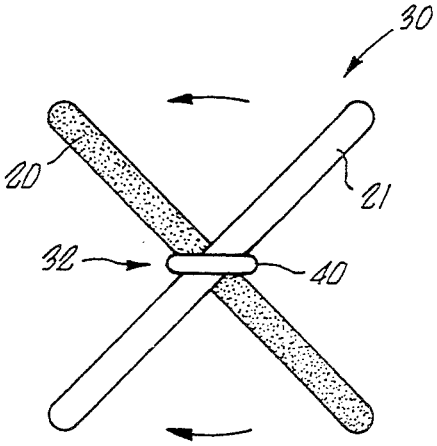
FIG. 5 is a side elevation view thereof with the hoops mutually rotated in opposite directions.

Referring to FIGS. 4 and 5, continuing with assembly of the frame, the first hoop 20 and second hoop 21 are rotated in opposite directions until they cross each other at about 90° at the first quadrant point 32. On the opposite side of the hoop assembly 30, the first hoop 20 and second hoop 21 are again rotated in opposite directions until they cross each other at about a 90° angle at the third quadrant point 36.

Figure 6:
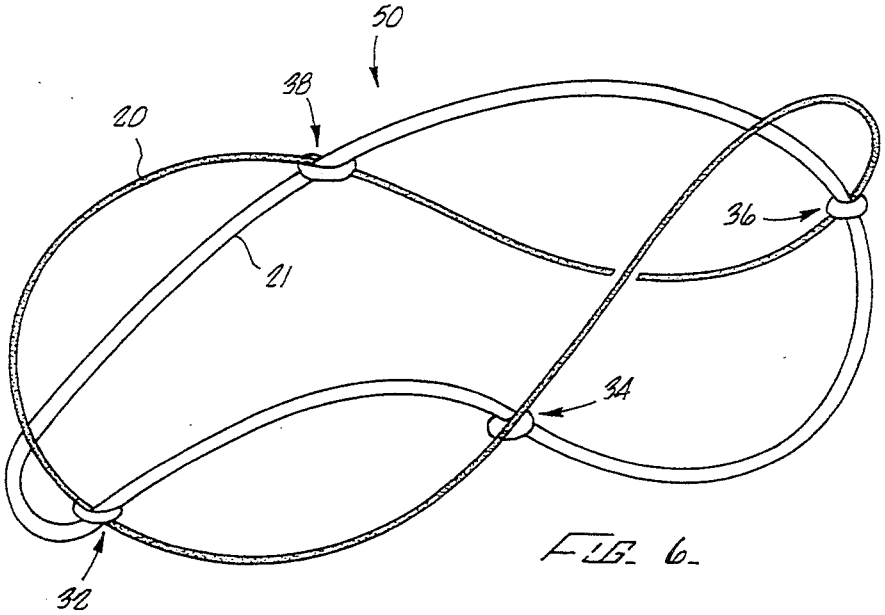
FIG. 6 is a perspective view of the hoop assembly of FIG. 5 showing the curvature of the first and second hoops, after they have been rotated as indicated in FIG. 5.
Figure 7:
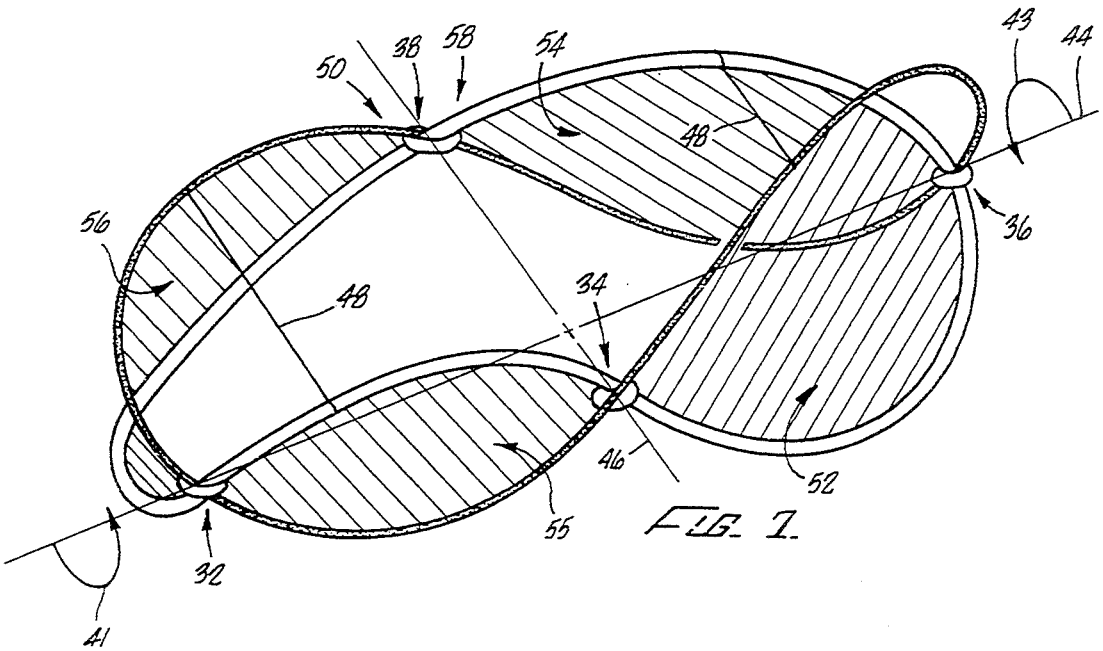
FIG. 7 is a perspective view of the hoop assembly of FIG. 6, with attached tension elements forming the present frame, and with shading provided only to designate the areas forming the sides of the frame.

As shown in FIGS. 6 and 7, in the resulting frame 50, the direction of rotation of the first hoop 20 is a left hand screw, that is, a plane travelling along hoop 20 from the first quadrant point 32 to the third quadrant point 36, rotates in a counterclockwise direction as viewed from the first quadrant point 32 along the major axis 44, shown in FIG. 7. (The major axis 44 is an imaginary line defined by the first and third quadrant points 32 and 36.) The direction of rotation of the second hoop 21 is a right hand screw, that is, a plane travelling along the second hoop 21 from the first quadrant point 32, to the third quadrant point 36, rotates in a clockwise direction as viewed from the first quadrant 32 along the major axis 44. The arrow 41 in FIG. 7 indicates the direction of rotation of the first hoop 20, and the arrow 43 indicates the opposite direction of rotation of the second hoop 21.

The twisted configuration of each hoop is maintained by tension elements 48, e.g., string, cord, cable, or a cloth strip or panel, etc., which run across the top 58 of the frame 50 and pull the frame into an oblong shape from its former round shape. With the frame 50 formed into its oblong shape, four frame side areas 52, 54, 55 and 56 are formed, as indicated by the shaded areas of FIG. 7. Correspondingly, the frame 50 generally forms a top 58 and bottom 60, as shown in FIGS. 7 and 11.

Figure 8:
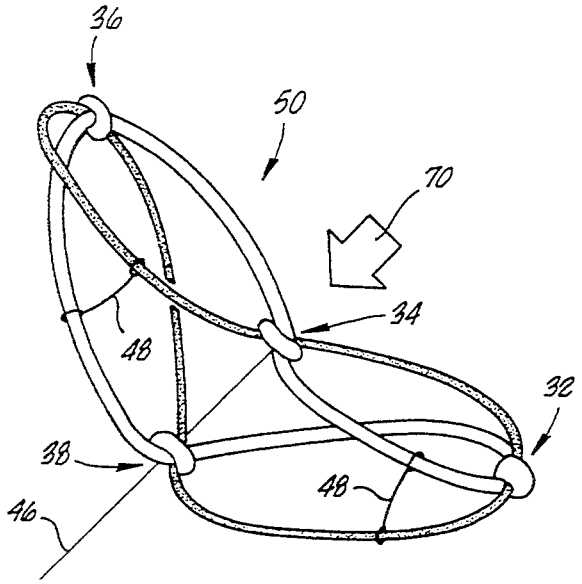
FIG. 8 is a perspective view of the hoop assembly of FIG. 7 illustrating the initial step in collapsing and folding the frame.
Figure 9:
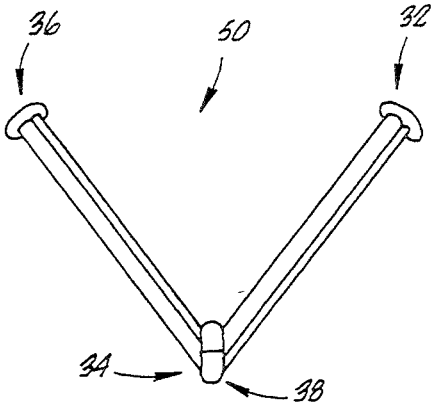
FIG. 9 is a front elevation view of the frame in an intermediate collapsing or folding step.
Figure 10:
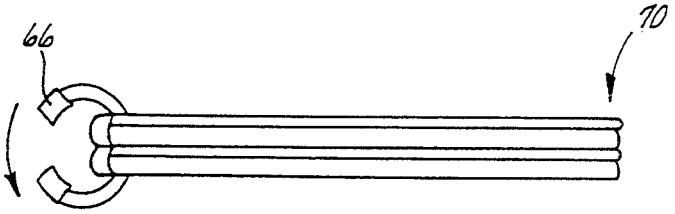
FIG. 10 is a side elevation view of the completely folded frame.

Turning to FIGS. 8, 9 and 10, the frame 50 can be folded or collapsed by bringing the second quadrant point 34 together with the fourth quadrant point 38, by pushing on the minor axis 46, in the direction shown by arrow 70. (The minor axis 46 is an imaginary line defined by the second and fourth quadrant points 34 and 38.) With the second and fourth quadrant points brought together, the frame 50 becomes v-shaped, as shown in FIG. 9. Referring to FIG. 10, the first quadrant point 32 and third quadrant 36 are then brought together into the flat hoop assembly 70, shown in FIG. 10. The hoop assembly 70 comprises four layers of the spiralling wire, in contrast to the flat or unspiraled hoops of FIG. 3. A quick release buckle 66 around each of the hoops of the flat hoop assembly 70 of FIG. 10 holds the assembly into the flat position. Without the quick release buckle or an equivalent, the first quadrant point 32 and third quadrant 36 of the folded frame 50 would immediately separate and the frame 50 would spring out to its full volume, as shown in FIGS. 6 and 7. The quick release buckle 66 holds the hoops together against their constant spring force. Of course, many equivalents for holding the hoops together may be used, for example, Velcro hook and loop closure material, spring clips, tape, etc.

Figure 11:
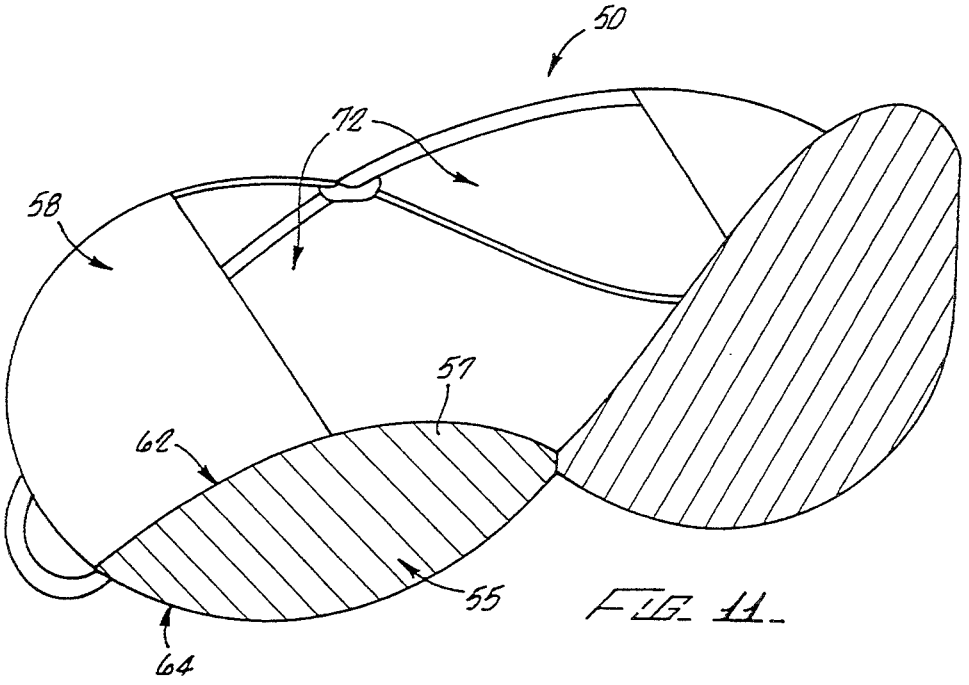
FIG. 11 is a perspective view of a preferred embodiment having fabric panels on the side of the frame, and across part of the top.

As shown in FIG. 11, fabric panels can be sewn together to cover one or more of the areas which are defined by the frame 50. For example, the sides 52 and 55 may be fully covered with fabric, with the top 58 partially covered with fabric, leaving open areas 72 in the top 58. Fabric panels on the top 58 or bottom 60, if used, hold the frame 50 into its oblong shape, and separate tension members 48 are not required.

When the frame 50 is collapsed or folded, the four generally oval-shaped sides 52, 54, 55 and 56, change shape and become circular. This change is shape causes the distance between the edges of each oval side to change. Referring to FIG. 11, as the frame 50 is folded and the sides flex from generally oval to circular, the distance between points 62 and 64 increases. Accordingly, the fabric panel 57 attached to the frame 50 and at the side 55 must be able to accommodate the change in dimensions. If the fabric panel 57 is simply securely fastened to the hoops at side points 62 and 64, and if the fabric panel 57 is in tension when the tent is set up (which ordinarily would be desired), then the fabric panel 57 would prevent the frame 50 from being collapsed, because the hoops would be restricted from moving from the generally oval shaped sides to circular. Accordingly, by making the fabric panels, such as panel 57, of an elastic fabric, the panels can be taut when the frame 50 is erected, while still allowing the frame 50 to be collapsed without restriction. The top 58 and bottom 60 can have elastic or non-elastic fabric panels, as non-elastic panels on the top and bottom do not hinder the necessary flexing and shape changing of the frame 50 when it is collapsed or folded. An advantage of elastic fabric panels is that they can provide an attraction for children, who can bounce against them for recreation, similar to a vertical trampoline surface. In another embodiment, the frame 50 may be provided with a non-stretchable fabric or material only on the top 58 and the bottom 60, with the sides left open.

Figure 15:
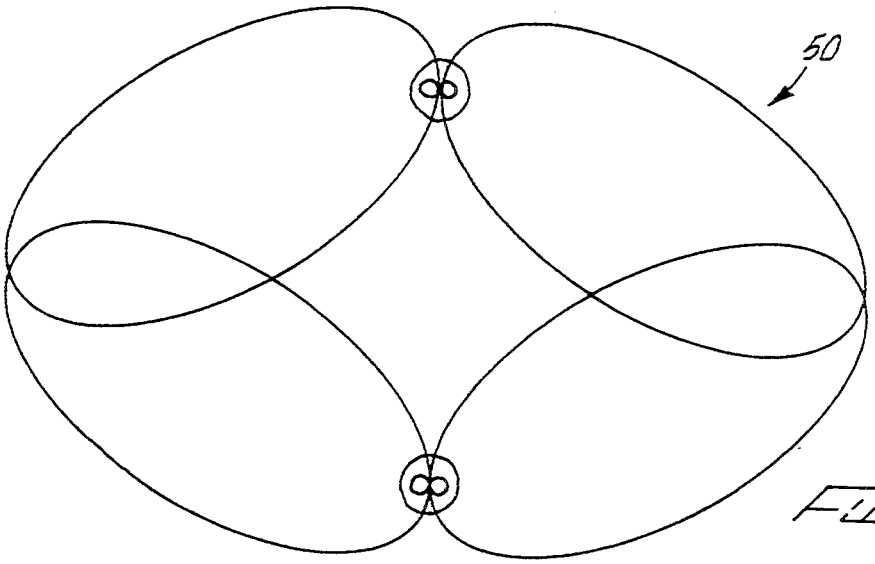
FIG. 15 is a schematic illustration of the present frame without a tension member.
Figure 16:
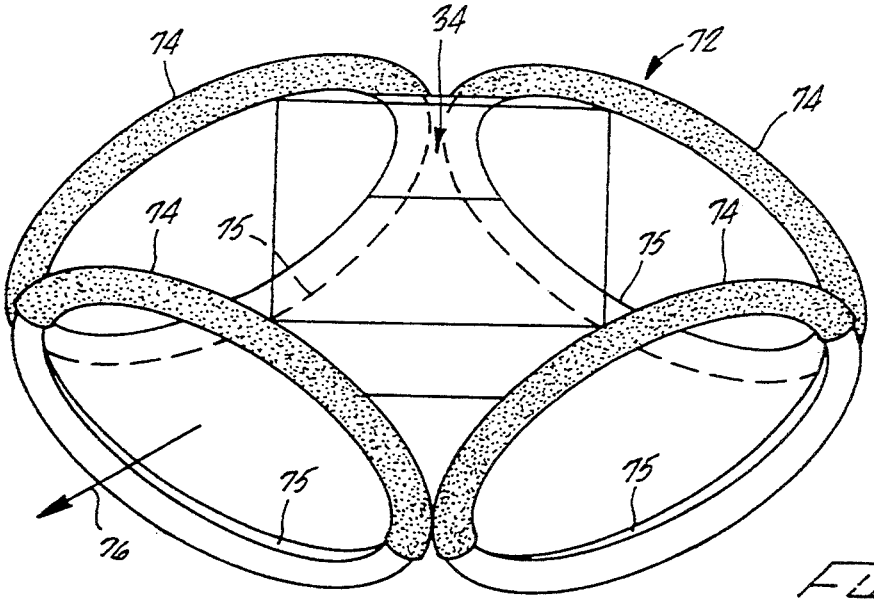
FIG. 16 is a schematic illustration showing assembly of a fabric bag onto the frame.
Figure 17:
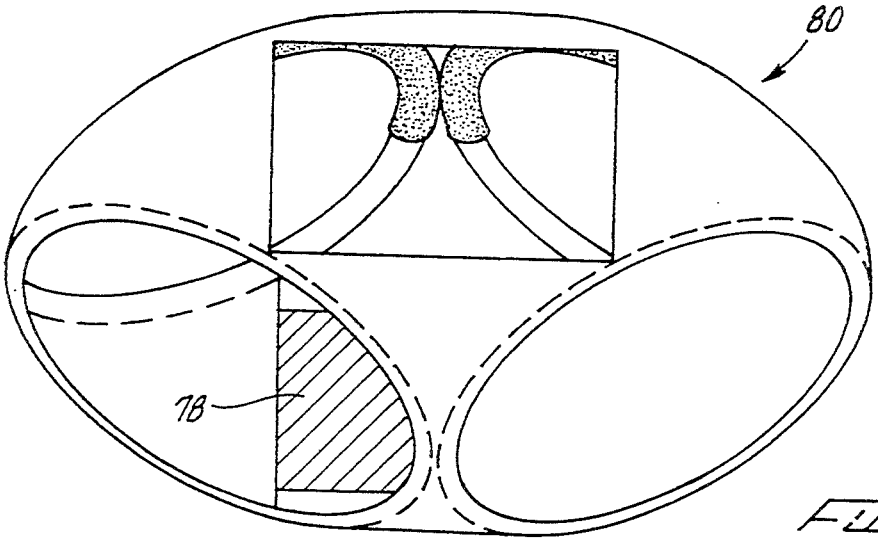
FIG. 17 is a perspective view of the frame and fabric bag, turned right side out, to form a tent.

Another way of allowing the frame 50 to be freely folded or collapsed is to allow the hoops to move independently of the fabric panels. Referring to FIGS. 15, 16 and 17, the frame is first erected, as shown in FIG. 15. Next, a fabric "bag" is sewn inside out and placed inside the frame 50. Pole sleeves 74 are sewn around the hoops 20 and 21, as shown in FIG. 16. The pole sleeves 74 attached around the top four edges of the frame 50 are substantially wider than the pole sleeves 75 attached to the frame 50 at the bottom four edges. In a preferred embodiment, the top pole sleeves 74 are approximately 3.0 inches wide, whereas the bottom pole sleeves 75 are approximately 0.5 inches wide. The sleeves are tubes of fabric sewn into seams which run approximately along the wire frame. The width of the sleeves varies depending on location. The wider sleeves 74 at the top allow for distortion of the wire frame, during folding.

After the eight pole sleeves, four top pole sleeves 74 and four bottom pole sleeves 75 are sewn, the hoops 20 and 21 are entirely covered by the sleeves, although the side areas 52, 54, 55 and 56, may remain open, as shown in FIG. 16. Referring to FIGS. 16 and 17, the frame 50 with the fabric "bag" 72 installed is then turned right side out by pulling the second quadrant point 34 through either opposite side 52 or 55. The arrow 76 in FIG. 16 shows the second quadrant point 34 pulled through the side 55, to turn the frame inside out. Alternatively, the frame 50 can remain with the pole sleeves 74, 75 oriented to the outside of the bag 72, that is, without inversion.

The resulting tent-like structure, as shown in FIG. 17 has a top 58 and bottom 60 covered by the fabric of the fabric bag 72. A floor 78 may optionally be sewn into the bag, and roof and side panels may also be added. As the fabric bag 72 is attached to the frame 50 only at the top 58 and bottom 60, and does not span across the sides 52, 54, 55 and 56, the tent 80 can be collapsed and folded without hinderance. As this occurs, the fabric of the bag 72 loosens and bunches up as the frame 50 is folded. Referring still to FIG. 17, if the fabric of the fabric bag 72 is not elastic, then no separate tension members 48 are required to hold the tent 80 into shape. On the other hand, if the fabric of the fabric bag 72 is elastic, and no inelastic floor 78 (or roof) is used, then separate tension members 48 must used, as shown in FIG. 7.

Figure 18:
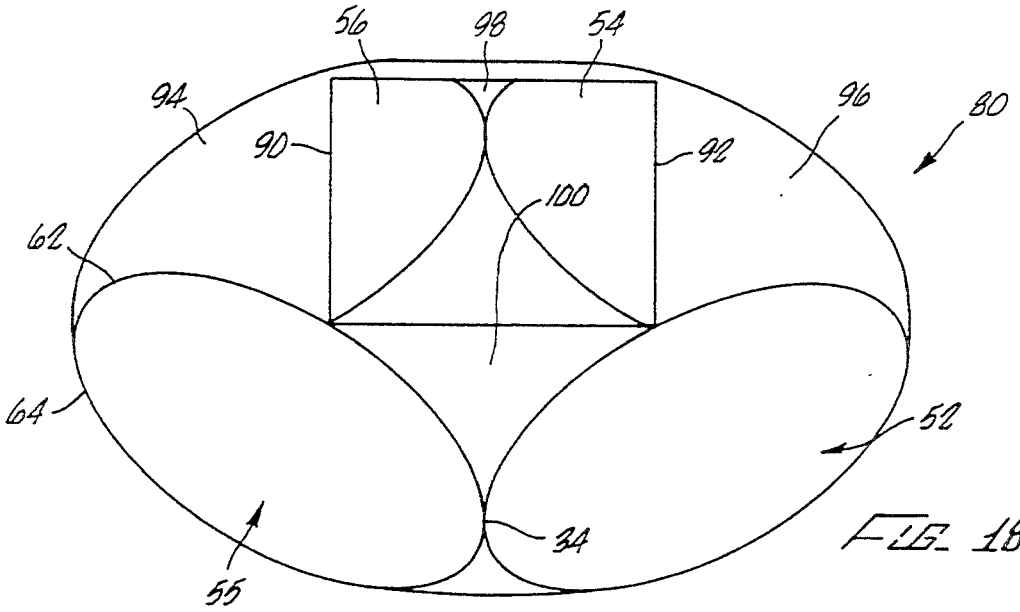
FIG. 18 is a schematic top view of the tent of FIG. 17.
Figure 19:
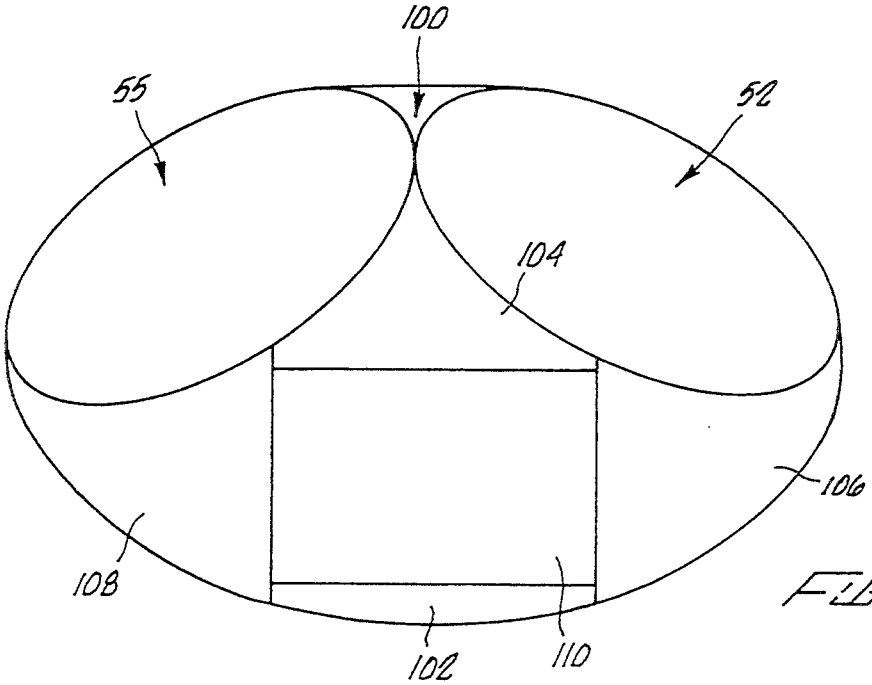
FIG. 19 is a schematic bottom view thereof.

Referring to FIGS. 18 and 19, large areas 90 and 92 can be divided into smaller areas 94, 96, 98 and 100. A rectangular is bounded by areas 94, 96, 98 and 100. The surface opposite from areas 90 and 92 is divided into areas 102, 104, 106 and 108, as shown in FIG. 19. A rectangular area 110 is bounded by areas 102, 104, 106 and 108. Any or all of these areas can be covered by fabric to form an enclosed volume. If areas 102 and 110 are not covered by fabric, the absence of fabric in areas 98, 100, 102 and 104, will cause the structure to be longer and lower. In the preferred embodiment, fabric covers areas 94, 96, 98, 100, 102, 104, 106 and 108.

Figure 12:
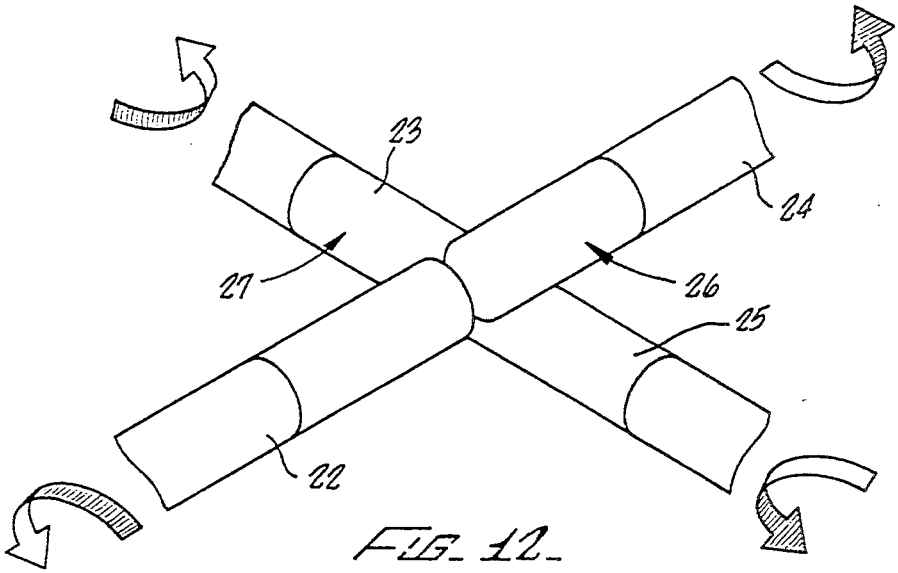
FIG. 12 is a schematic illustration of the joining of the ends of the hoops.

Referring once again to FIGS. 1 and 2, when the first hoop and second hoop 21 are formed, the ends of each hoop must be allowed to freely rotate axially relative to each other, as the frame 50 expands and collapses. The amount of rotation is about 90°, and is achieved via the pivot joints 26 and 27. Without the pivot joints, rotation of the hoop ends would be restricted and the frame 50 would be unable to freely expand or collapse. If the first hoop 20 and second hoop 21 are made of sufficiently torsionally flexible materials, their ends may be solidly joined, and the pivot joints eliminated. FIG. 12 shows the relative movement of the hoop ends. This movement allows the frame 50 to be easily and automatically set up.

Figure 13:
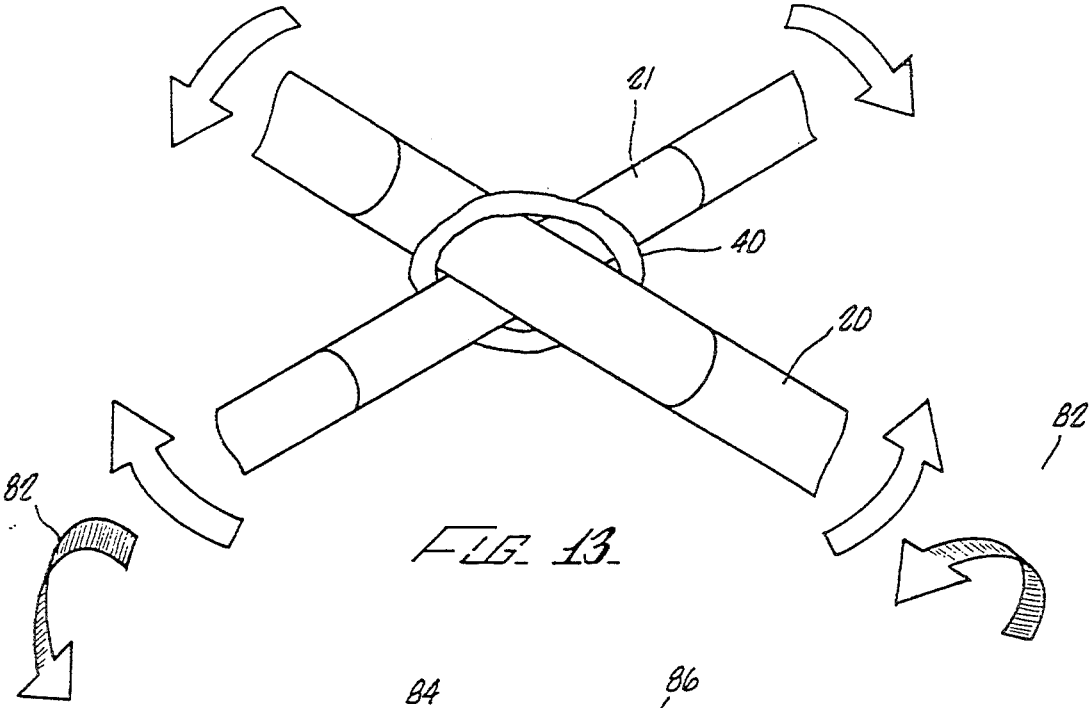
FIG. 13 is a schematic illustration of the joints at hoop intersections.

Movement at the quadrant points is shown in FIG. 13. The fastener 40 attaches the two hoops 20 and 21 at the quadrant point, or intersection, and prevent the hoops from translating relative to each other. However, the hoop sections at the intersection are free to rotate relative to each other, in a scissors-like action. In addition, each hoop section adjacent the intersection is free to rotate independently about its own axis, as indicated by the arrows 82 in FIG. 13. The fastener 40 may be an elastic band, or molded elastic or rubber connector, can be used to achieve these results.

Figure 14:
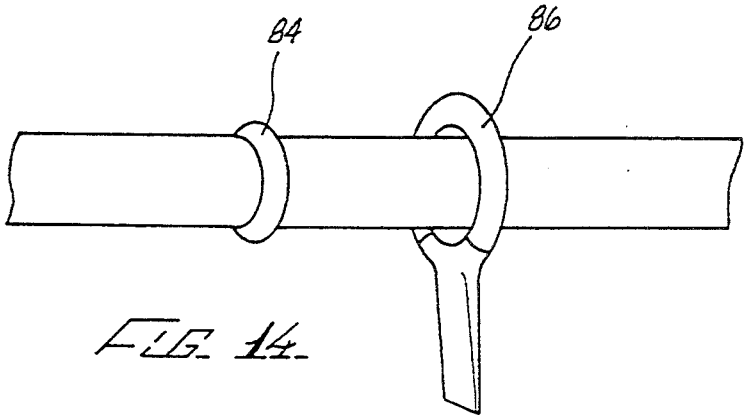
FIG. 14 is a preferred embodiment for attaching fabric to the frame.

Referring to FIG. 14, in another embodiment of an intersection connection, a ring 84 is permanently attached to each hoop at the intersection. The hoop is then threaded through one or two movable rings 86 which are permanently attached to the fabric at each intersection.

Referring to FIGS. 7, 11 and 17, the present frame 50 or tent 80 can be made with an opening in one or more of its sides for entrance and egress by a child. Several tents 80 can be set up by the child or by a parent into different arrangements so a child can crawl through one tent to the next. They can also be used as hiding places. Both of these activities are well known play habits of children. The tent 80, or modifications to it, are also suitable for light use camping. The fabric panels, for example, can be a water proof and breathable material.

Thus, a novel frame and tent have been shown and described. Various modifications may be thereunto without departing from the spirit and scope of the present invention.

What is claimed is:

1. A collapsible frame comprising:

a first hoop;

a second hoop attached to the first hoop at generally equally spaced apart first, second, third, and fourth quadrant points, with the first hoop crossing the second hoop at approximately right angles at the first and third quadrant points;

a first tension member joining the first hoop and the second hoop; and a second tension member spaced apart from the first tension member, and joining the first hoop and the second hoop.

2. The frame of claim 1 further comprising a fabric panel attached to the first hoop and the second hoop.

3. The frame of claim 1 further comprising an elastic panel attached to the first hoop and the second hoop.

4. The frame of claim 1 wherein at least one of the first hoop and the second hoop comprise spring steel wire.

5. The frame of claim 1 further comprising a swivel joint on one of the first hoop and the second hoop.

6. The frame of claim 1 further comprising elastic hoop fasteners at the quadrant points, for holding the hoops together.

7. The frame of claim 1 wherein at least one of the tension elements comprises a sheet of fabric.

8. The frame of claim 1 wherein at least one of the tension elements comprises a cord.

9. A collapsible and self erecting frame comprising:

a first wire hoop having ends generally axially aligned with each other and joined to each other in a pivotable joint;

a second wire hoop also having ends generally axially aligned with each other and joined to each other in a pivotable joint;

the first hoop and the second hoop rotated with respect to each other such that they cross each other at approximately right angles at a first quadrant point and at a third quadrant;

first, second, third, and fourth hoop fasteners substantially equally spaced apart from each other, and located at first, second , third, and fourth quadrant points;

the first and third quadrant points defining a major axis of the frame, and the second and fourth quadrant points defining a minor axis of the frame extending substantially perpendicular to the major axis;

a first tension member joining the first hoop and the second hoop at a position between the first quadrant point and the minor axis; and a second tension member joining the first hoop and the second hoop at a position between the third quadrant point and the minor axis.

10. The frame of claim 9 wherein the first tension member and the second tension member are formed by a sheet of fabric attached to the first frame and to the second frame.

11. The frame of claim 10 further comprising a quick release fastener attached to the frame, for holding the first quadrant point adjacent to the third quadrant point, to maintain the frame in a collapsed position.

12. A method of forming a frame comprising the steps of:

forming a first hoop by joining the ends of a length of wire into a connection which generally axially aligns the ends and allows them to pivot with respect to each other;

forming a second hoop by joining the ends of a length of wire into a connection which generally axially aligns the ends and allows them to pivot with respect to each other;

attaching the first hoop to the second hoop at first, second, third, and fourth attachment points, while allowing the first hoop and second hoop to pivot with respect to each other at the attachment points;

rotating the first hoop and the second hoop in opposite directions until they cross each other at about right angles at the first and third attachment points;

attaching a first tension member to the first hoop and to the second hoop at a location between the first attachment point and a line passing through the second and fourth attachment points;

attaching a second tension member to the first hoop and to the second hoop at a location between the third attachment point and a line passing through the second and fourth attachment points.

13. The method of claim 12 further comprising the steps of:

bringing the second attachment point to a position adjacent to the fourth attachment point, to form a generally v-shaped frame; and bringing the third attachment point to a position adjacent the first attachment point, to place the frame into its completely collapsed position.

* * * * *